US005586701A

United States Patent [19]

Kim

[11] Patent Number: 5,586,701

[45] Date of Patent: Dec. 24, 1996

[54] HANDGUN HOLSTER

[75] Inventor: Kwon K. Kim, Seoul, Rep. of Korea

[73] Assignee: Samduck Sanggong Co., Ltd., Seoul, Rep. of Korea

[21] Appl. No.: 536,208

[22] Filed: Sep. 29, 1995

[30] Foreign Application Priority Data

May 4, 1995 [KR] Rep. of Korea ..... 9576

[51] Int. Cl.[6] ..... F41C 33/02

[52] U.S. Cl. ..... 224/243; 224/236; 224/901.2

[58] Field of Search ..... 224/243, 226, 224/228, 235, 236, 237, 238, 239, 240, 234, 232, 901, 904, 911, 914; 383/84, 86; 150/118, 150, 152

[56] References Cited

U.S. PATENT DOCUMENTS

| | | | |
|---|---|---|---|
| 4,286,741 | 9/1981 | Rogers | 224/238 |
| 4,312,466 | 1/1982 | Clark | 224/243 |
| 4,750,655 | 6/1988 | Barry | 224/243 |

*Primary Examiner*—David J. Walczak
*Attorney, Agent, or Firm*—Klauber & Jackson

[57] ABSTRACT

The present invention provides a three-way fastening mechanism for a handgun holster flap (2). A loop fastening part (3*b*) and a subordinate fastening piece (4), which has a hook fastening part (a) and a loop fastening part (b) formed on opposite sides thereof, are secured to the outer surface of a handgun holster (1). A hook fastening part (3*a*') is formed on the inner surface of a holster flap (2) at the end thereof, a loop fastening part (3*b*') is formed on the outer surface of the holster flap (2) at the end thereof, and a loop fastening part (3*b*") is formed on the inner surface of the holster flap (2) at the beginning thereof. The flap (2) can be fastened in three different ways as follows: in a normal situation, the flap (2) is securely fastened to the loop fastening part (3*b*) on its inner surface and the subordinate fastening piece (4) on its outer surface; in an emergency situation, the flap (2) is fastened only on its inner surface to the subordinate fastening piece (4), which, in turn, is fastened to the loop fastening part (3*b*); in an operational situation, the flap (2) is folded and fastened to the loop fastening part (3*b*").

5 Claims, 4 Drawing Sheets

HANDGUN HOLSTER

FIELD OF THE INVENTION

The present invention relates to holsters and, more particularly, to a handgun holster having a flap that may be arranged in a plurality of fastening positions.

DESCRIPTION OF THE PRIOR ART

Handgun holsters typically have a single flap which is fastened at only one point on the side of the holster by a snap or the like. Such a flap may be easily opened by being caught on surrounding objects, causing a handgun to fall out of the holster. When such a flap is not fastened, the flap hangs outward, causing inconvenience in use. Thus, it would be desirable to provide a handgun holster having a flap that is not easily opened, thereby preventing potentially dangerous access to a handgun contained therein, and that does not otherwise interfere with a user or wearer of the holster.

SUMMARY OF THE INVENTION

The present invention contemplates a handgun holster having a flap that may be arranged in a plurality of fastening positions which allow a handgun to be safely carried within the holster and which do not result in the flap interfering with a user or wearer of the holster.

The present invention relates generally to fastening the flap of a handgun holster using hook-and-loop tape, and is particularly directed to a 3-way fastening mechanism of the handgun holster flap wherein a loop fastening part and a subordinate fastening piece are attached to the outer surface of the holster by sewing, a hook fastening part and a loop fastening part are formed on the inner and outer surfaces at the end of the flap, and a hook fastening part is formed on the inner surface at the beginning of the flap. These added parts and pieces to the handgun holster enable three different types of handgun holster flap fastening. First, in a normal situation, the handgun holster flap is safely fastened on both its sides by the loop fastening part attached to the outer surface of the holster and the subordinate fastening piece. Second, in an emergency situation, the flap is fastened on only one side and can be opened easily. Third, in an operational situation, the flap is folded inside maintaining an open state so that the handgun can be pulled out instantly when needed.

From the above descriptive summary it is apparent how the present invention overcomes the shortcomings of the above-mentioned prior art.

Accordingly, the primary objective of the present invention is to provide a handgun holster having a flap that may be arranged in a plurality of fastening positions which allow a handgun to be safely carried within the holster and which do not result in the flap interfering with a user or wearer of the holster.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

PREFERRED EMBODIMENT OF THE PRESENT INVENTION

Figure 1:
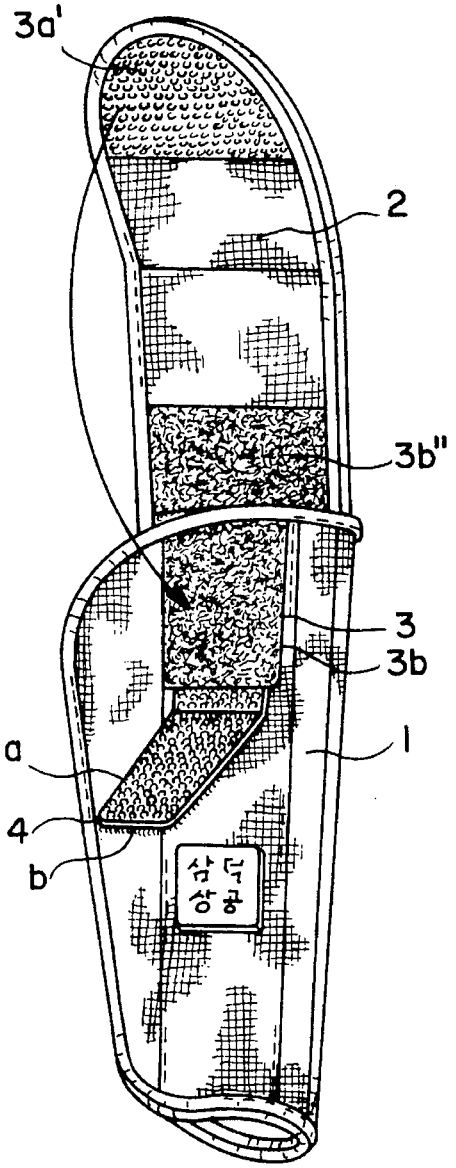
FIG. 1 is an illustration of a handgun holster according to the present invention.

Referring to FIGS. 1–9, the present invention allows the fastening of a flap (2) of a handgun holster (1) by hook fastening parts (a) and loop fastening parts (b) and by using conventional hook-and-loop tape (3) in order to address the problems of the prior art. A loop fastening part (**3*b*) and a subordinate fastening piece (4) are formed on the outer surface of the holster (1), a hook fastening part (3*a*') and a loop fastening part (3*b*') are formed on opposite surfaces of the flap (2) at its end, and a loop fastening part (3*b*") is formed on the inner surface of the flap (2) at its beginning. These added parts and pieces enable three different types of handgun holster flap fastening including two-side fastening, one-side fastening, and folded flap fastening. In a normal situation, the two-side fastening scheme is used wherein the handgun holster flap (2) is securely fastened on both sides by the loop fastening part (3*b*) and the subordinate fastening piece (4) so that the flap (2) can't be opened unless the subordinate fastening piece (4) is pulled open, thereby preventing accidental unfastening of the holster (1) and the loss of a gun (5) contained therein. In an emergency situation, such as patrol, the one-side fastening scheme is used wherein the flap (2) is fastened only on its inner surface to a loop fastening part (b) of the subordinate fastening piece (4), which is in turn fastened to the loop fastening part (3*b*), and thus the flap (2) can be easily opened. In an operational situation, the folded flap fastening scheme is used wherein the flap (2) is folded and fastened inside the holster (1), maintaining it in an open state, so that a handgun (5) can be pulled out instantly when needed, and the flap (2**) is held in a tidily folded state.

The flap (2), the loop fastening part (**3*b*), and the subordinate fastening piece (4) are attached to the outer surface of the holster (1) by sewing. Flap (2) is provided with a set of hook fastening parts (3*a*') and loop fastening parts (3*b*, 3*b*") formed with fastening tape (3**). Subordinate fastening piece (4) has a loop fastening part (b) and a hook fastening part (a) on opposite sides thereof wherein the hook (a) and loop (b) fastening parts may be formed with hook and loop tape (3). The hook fastening part (3*a*') is formed on the inner surface of the flap at its end, and the loop fastening part (3*b*") is formed on the inner surface of the flap (2) at its beginning by sewing.

Figure 2:
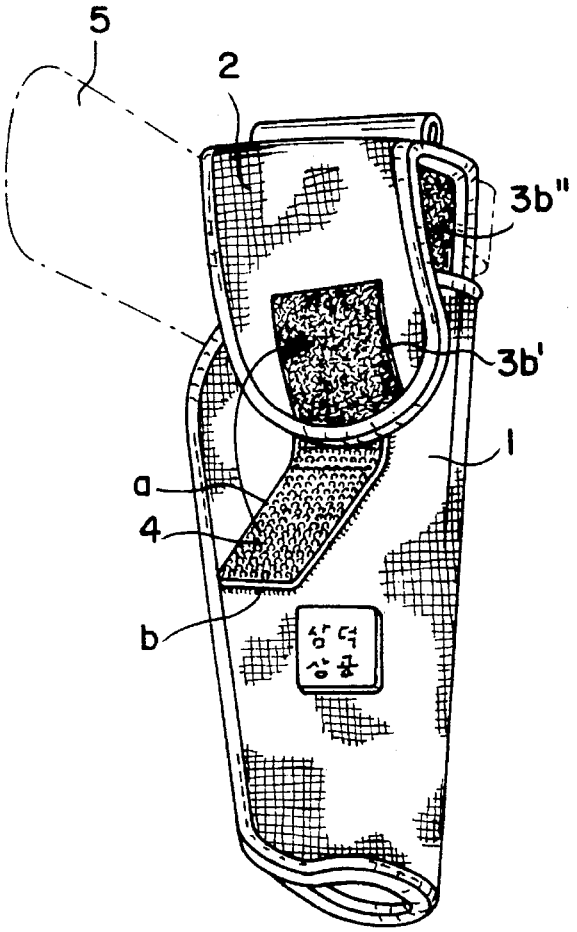
FIG. 2 is an illustration showing the state of fastening the subordinate fastening tape to the flap of the handgun holster shown in FIG. 1.
Figure 3:
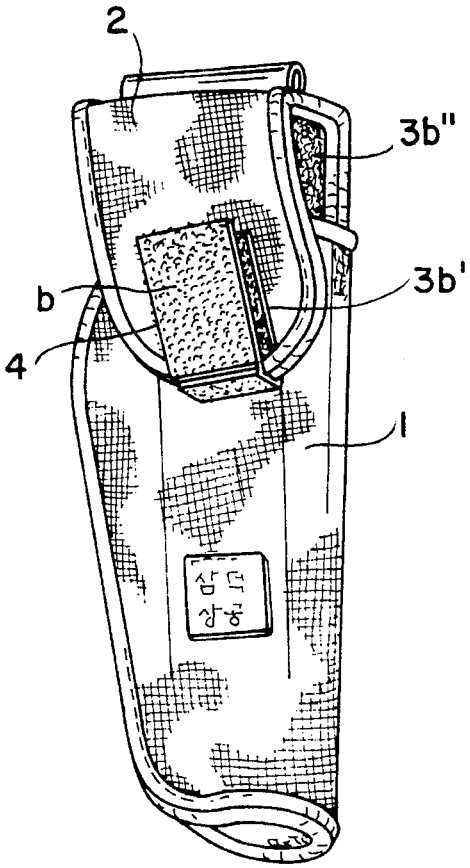
FIG. 3 is an illustration showing the state of two-side fastening of the flap of the handgun holster shown in FIG. 1.

In the present invention formed as described above, the handgun (5) is inserted in the opening of the holster (1) and the flap (2) is fastened by the hook-and-loop tape (3). For safe carrying in a normal situation, the subordinate fastening piece (4) is pulled open, as shown in FIG. 2, and the hook fastening part (3*a*') formed on the inner surface of the flap (2) is fastened to the loop fastening part (3*b*) formed on the holster (1) and then, as shown in the FIG. 3, the hook fastening part (a) of the subordinate fastening piece (4) is fastened to the loop fastening part (3*b*') formed on the outer surface of the flap (2), and thus, as also shown in the FIG. 7, both surfaces of the flap (2) are fastened in a duplicate manner.

Figure 4:
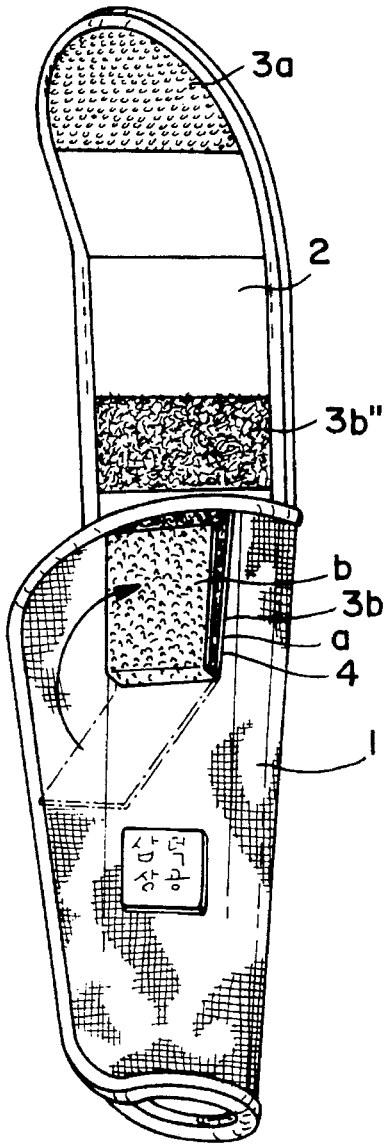
FIG. 4 is an illustration showing the state of fastening the subordinate fastening tape to itself for the handgun holster shown in FIG. 1.
Figure 5:
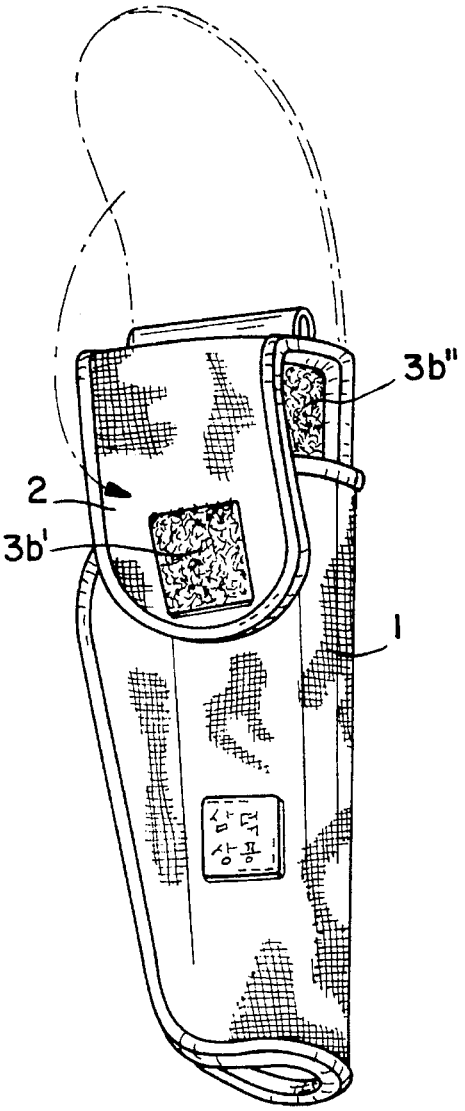
FIG. 5 is an illustration showing the state of one-side fastening of the flap of the handgun holster shown in FIG. 1.
Figure 8:
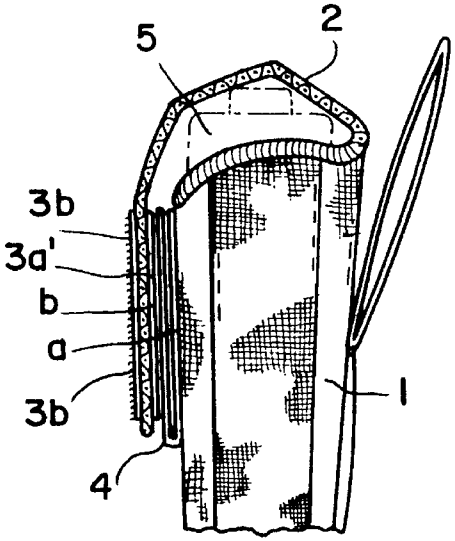
FIG. 8 is a partially cutaway side view of the handgun holster when in the state of one-side fastening of the flap of the handgun holster as shown in FIG. 5.
Figure 7:
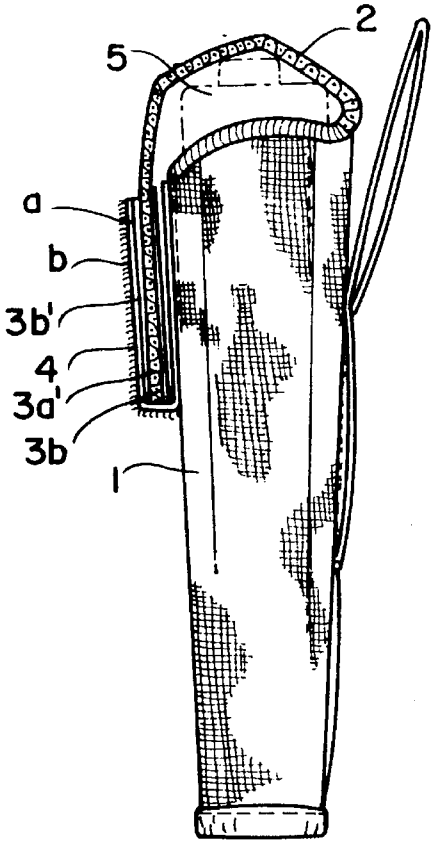
FIG. 7 is a side view of the handgun holster when in the state of two-side fastening of the flap of the handgun holster as shown in FIG. 3.

On patrol or in an emergency situation, as shown in FIG. 4, the hook fastening part (a) of the subordinate fastening piece (4) is fastened to the loop fastening part (3*b*) formed on the holster (1), and, as shown in FIG. 5, the hook fastening part (3*a*') formed on the inner surface of the flap (2) is fastened to the loop fastening part (b) formed on the surface of the subordinate fastening piece (4), and thus, as also shown in FIG. 8, the flap (2) is fastened to the holster (1) on only one surface.

Figure 6:
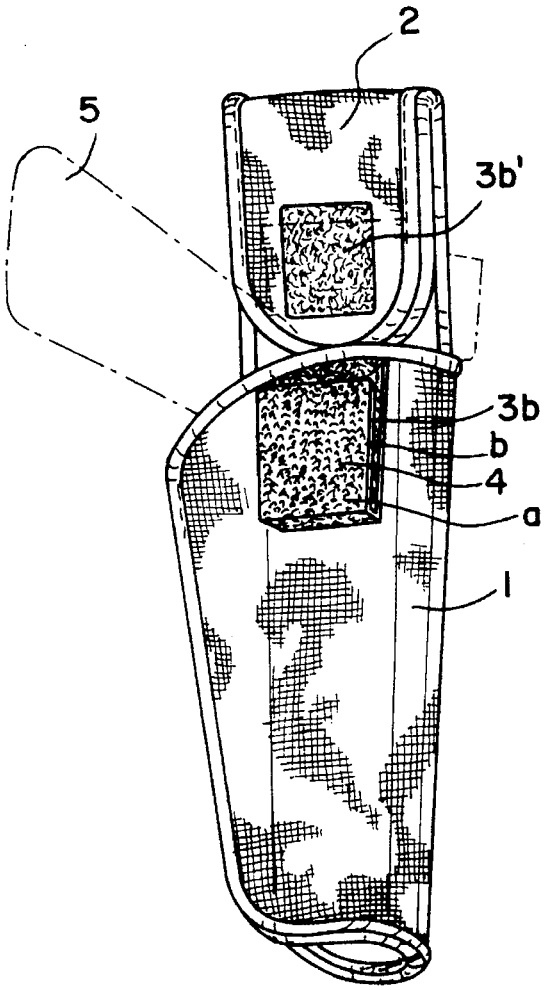
FIG. 6 is an illustration showing the state of fastening by folding the flap inside for the handgun holster shown in FIG. 1.
Figure 9:
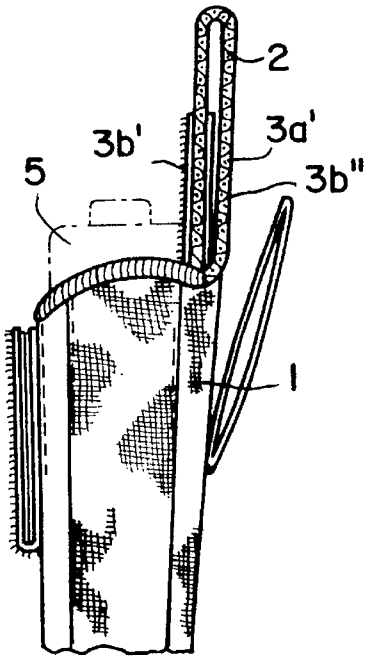
FIG. 9 is a partially cutaway side view of the handgun holster when in the state of fastening by folding the flap of the handgun holster inside as shown in FIG. 6.

During operations, half of the flap (2) is folded in and the hook fastening part (3*a*'), formed on the inner surface of the flap (2) at its end, is fastened to the loop fastening part (3*b*"), formed on the inner surface of the flap (2) at its beginning, as shown in FIG. 6, and then the flap is neatly secured, maintaining its open state, as also shown in FIG. 9.

Thus, the present invention allows three different types of handgun holster flap fastenings, including two-side fastening, one-side fastening, and folded flap fastening, and if the flap (2) is fastened on both its sides, the flap (2) can not be opened unless the subordinate fastening piece (4) is pulled open, and thus the flap (2) won't be unfastened accidentally, preventing loss of the gun (5) by safely carrying of the gun (5), and if the flap (2) is fastened only on one side, it can be opened easily, thereby allowing the handgun (5) to be carried safely in an emergency and pulled out quickly when needed, and if the flap (2) is folded and fastened inside, the flap (2) is maintained in a tidily folded state and the handgun (5) can be pulled out instantly when needed without experiencing the hindrance of a hanging flap, so it can be used more safely and conveniently, the selection being made depending upon the purpose.

With the present invention handgun holster (1) now fully described, it can thus be seen that the primary objective set forth above is efficiently attained and, since certain changes may be made in the above-described embodiment without departing from the scope of the invention, it is intended that all matter contained in the above description or shown in the accompanying drawings shall be interpreted as illustrative and not in a limiting sense.

What is claimed is:

1. A handgun holster having a flap that may be arranged in a plurality of fastening positions, said handgun holster comprising:

a holster body (1), said holster body (1) having an inside surface and an outside surface, said outside surface of said holster body having a loop fastening part (3*b*) formed thereon, said outside surface of said holster body having a subordinate fastening piece (4) secured thereto, said subordinate fastening piece (4) having a hook fastening part (a) and a loop fastening part (b) formed on opposite sides thereof; and a holster flap (2), said holster flap (2) having a beginning portion and an ending portion, said beginning portion of said holster flap being secured to said holster body (1), said holster flap (2) having an inside surface and an outside surface corresponding to said inside surface and said outside surface of said holster body (1), said inside surface of said ending portion of said holster flap having a hook fastening part (3*a*') formed thereon, said outside surface of said ending portion of said holster flap having a loop fastening part (3*b*') formed thereon, said inside surface of said beginning portion of said holster flap having a loop fastening part (3*b*") formed thereon.

2. The handgun holster as defined in claim 1, wherein said hook and loop fastening parts are formed with conventional hook-and-loop tape (3).

3. The handgun holster as defined in claim 1, wherein said holster flap (2) and said subordinate fastening piece (4) are foldable so as to allow said hook fastening part (3*a*') of said inside surface of said ending portion of said holster flap to be fastened to said loop fastening part (3*b*) of said outside surface of said holster body, and said loop fastening part (3*b*') of said outside surface of said ending portion of said holster flap to be fastened to said hook fastening part (a) of said subordinate fastening piece (4).

4. The handgun holster as defined in claim 1, wherein said holster flap (2) and said subordinate fastening piece (4) are foldable so as to allow said hook fastening part (a) of subordinate fastening piece (4) to be fastened to said loop fastening part (3*b*) of said outside surface of said holster body, and said loop fastening part (b) of said subordinate fastening piece (4) to be fastened to said hook fastening part (3*a*') of said inside surface of said ending portion of said holster flap.

5. The handgun holster as defined in claim 1, wherein said holster flap (2) and said subordinate fastening piece (4) are foldable so as to allow said hook fastening part (3*a*') of said inside surface of said ending portion of said holster flap to be fastened to said loop fastening part (3*b*") of said inside surface of said beginning portion of said holster flap, and said hook fastening part (a) of said subordinate fastening piece (4) to be fastened to said loop fastening part (3*b*) of said outside surface of said holster body.

* * * * *